United States Patent [19]

Krautsack

[11] Patent Number: 5,050,747

[45] Date of Patent: Sep. 24, 1991

[54] COUPON DISPLAY AND DISTRIBUTION UNIT

[75] Inventor: Richard G. Krautsack, Arlington Heights, Ill.

[73] Assignee: Comark Merchandising, Inc., Elk Grove Village, Ill.

[21] Appl. No.: 443,770

[22] Filed: Nov. 30, 1989

[51] Int. Cl.[5] ..... A47F 7/00

[52] U.S. Cl. ..... 211/50; 211/55

[58] Field of Search ..... 211/50, 55, 56, 133; 40/124

[56] References Cited

U.S. PATENT DOCUMENTS

| | | | |
|---|---|---|---|
| 766,629 | 8/1904 | Koehler | 40/124 |
| 838,294 | 12/1906 | Zeiner | 40/124 |
| 2,043,791 | 6/1936 | Barron | 211/133 X |
| 2,710,473 | 6/1955 | Kress et al. | 211/55 X |
| 2,805,502 | 9/1957 | Smith et al. | 40/124 |
| 3,012,348 | 12/1961 | Smith | 211/50 X |
| 4,580,685 | 4/1986 | Jorquez | 211/56 |
| 4,609,975 | 9/1986 | Badolato et al. | 211/194 X |

*Primary Examiner*—Robert W. Gibson, Jr.

*Attorney, Agent, or Firm*—Fitch, Even, Tabin & Flannery

[57] ABSTRACT

A coupon display and dispensing unit has a plurality of channel members slidably supporting a plurality of removable modular rectangular coupon holders having coupon receiving and holding pockets formed therein. A base having a base dispenser pocket for holding promotional material to be dispensed supports the channel members and the removable modular rectangular coupon holders.

6 Claims, 4 Drawing Sheets

COUPON DISPLAY AND DISTRIBUTION UNIT

BACKGROUND OF THE INVENTION

The present invention relates to retail displays and in particular to a coupon display and distribution unit for holding groups of coupons where they can be viewed and easily picked up by a retail customer.

It is well known that manufacturers of food and other consumer products, in the course of their marketing activities, often wish to increase the sales of particular items by offering advantageous price terms to their customers. One method of doing so is by employing coupons. Typically, the coupon allows the customer to purchase the product for less than the list price of the product in the store. Such coupons have in the past been printed in general circulation newspapers and magazines, which required the consumer to search the publication for the coupons and clip the coupons out of the publication. The customer also had to remember to carry them to the store where they were to be redeemed in. This, of course, was inconvenient for the customer and potentially may result in lost sales due to the number of steps in the redemption process.

Recently, stores have displayed coupons typically glued to tear-away pads for use by the customers in the store. The customer may tear the coupon off the pad and carry it with her or him to the check-out area of the store where the product is purchased. Often the pad is glued or adhesively attached to a fiberboard or cardboard display so that when the tear-away coupons are consumed the entire display must be replaced with a new display. Since the coupons often are organized with only single brand coupons per display, the customer may be required to go from point to point in the store looking for additional coupons for the same or similar types of foodstuffs, resulting in inconvenience for the customer. In addition, if the coupons have been used up, due to higher demand than anticipated for the product, the customer may no longer be able to take advantage of the advantageous pricing, and the seller of the product may be unable to make additional sales due to the exhaustion of the coupons. It is clear that it is desirable to be able to display the coupons prominently in the store where the customers can obtain them. Among patents related to such displays are U.S. Pat. No. 2,147,869 to Wales for Display Stand that discloses a rounded triangular display stand. The stand has a plurality of card or sign frames 34 for holding signs to be perused. The cards may be inserted through open ends of the frames. U.S. Pat. No. 3,517,905 to Nestegard for Sign Holder discloses a triangular cross section sign holder having rectangular frame members for holding vertically elongated posters or sign cards. U.S. Pat. No. 3,969,838 to Moore for Sign discloses a double-faced elongated rectangular generally flat sign having a pair of back-to-back channel members for receiving interchangeable sign cards and having end members at least one of which is removable. U.S. Pat. No. 4,202,121 to Maris et al. for Display Device discloses a modular graphic display having fins arranged at 120° intervals for slidably holding photographs and the like. U.S. Pat. No. 4,608,773 to White for Kiosk Display Unit discloses a pedestal having three display panels extending therefrom. The panels are held in sheet metal posts 36. U.S. Pat. No. 4,815,612 to Leo, Sr. for Display for Packaged Supplies discloses an opposed panel display having a pair of removable panels 10 and 11, each able to receive a plurality of removable hooks 31 for holding goods to be sold.

The aforementioned prior art patents are directed to solving problems primarily related to the display of signs or products and not for the easy and convenient dispensing of coupons. What is needed is an apparatus and method for easy and rapid dispensing and replenishment of coupons so that when the coupons are exhausted, they may be quickly and easily restocked in the coupon display and dispensing unit.

SUMMARY OF THE INVENTION

The present invention is directed to a coupon display and distribution unit having a removable modular coupon holder including multiple display pockets for holding loose coupons in an attractive display. The pockets are composed of a clear styrene which allows the consumer to quickly and easily read the coupons contained throughout the display at a glance and pick out the coupons of his or her choice. The modular construction allows the coupon holder to be slid in and out of channel members of the coupon display and distribution unit so that all pockets of the coupon holder may be loaded with coupons at a central location. The loaded modular coupon holder may then be brought to a store and replace partially emptied or emptied coupon holders in coupon display and distribution units within the store. The modular coupon holder, in addition, includes coupon abutment members which help to prevent the loose coupons held within the pockets from sliding out of the pockets during transport. The coupon abutment members have convenient finger recesses for allowing the coupons to be taken from the display pockets quickly and easily.

The coupon display and distribution unit includes a plurality of channel members for holding at least three, and in a stacked configuration, six or more removable modular coupon holders in the coupon display and distribution unit. In addition, an open pocket is provided underneath the three-sided modular coupon frame for holding additional marketing or promotional material which may easily and quickly be viewed and/or picked up by a retail customer.

It is a principal aspect of the present invention to provide a coupon display and distribution unit which may be quickly and easily reloaded with coupons.

It is another aspect of the present invention to provide a coupon display and distribution unit which has removable modular coupon holders for easy loading of a plurality of coupons simultaneously into the unit.

Other aspects of the present invention will become apparent upon a perusal of the specification and claims in light of the accompanying drawings.

DESCRIPTION OF THE PREFERRED EMBODIMENT

Figure 1:
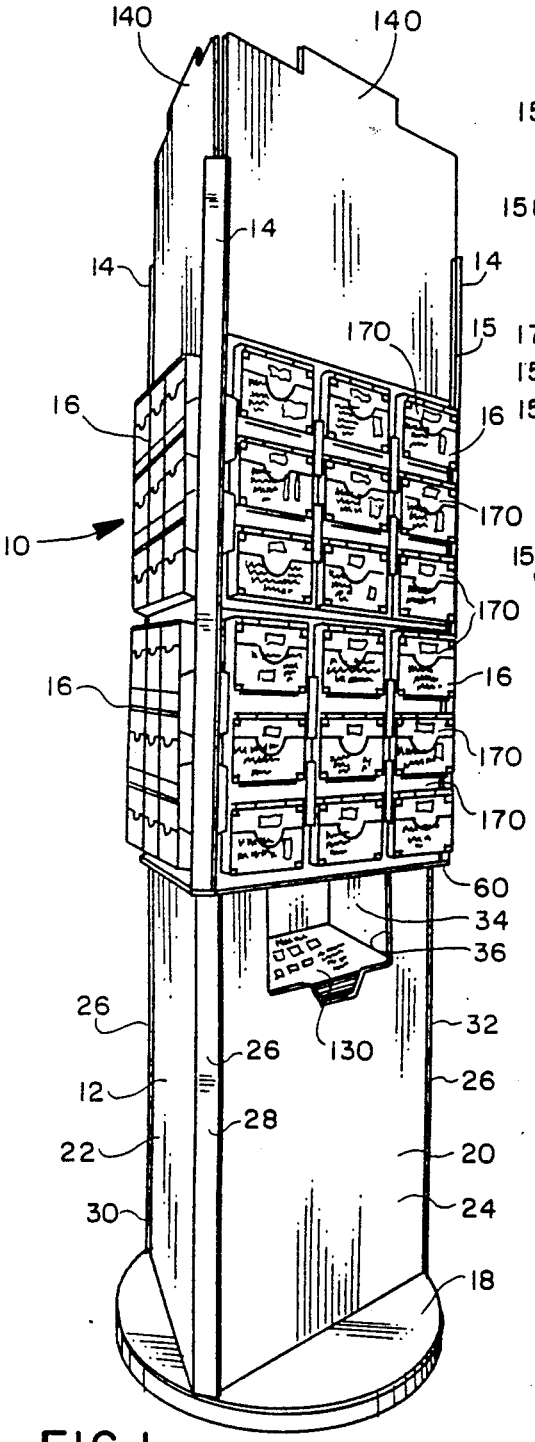
FIG. 1 is an isometric view of a coupon display and distribution unit with coupons held therein and embodying the present invention.
Figure 2:
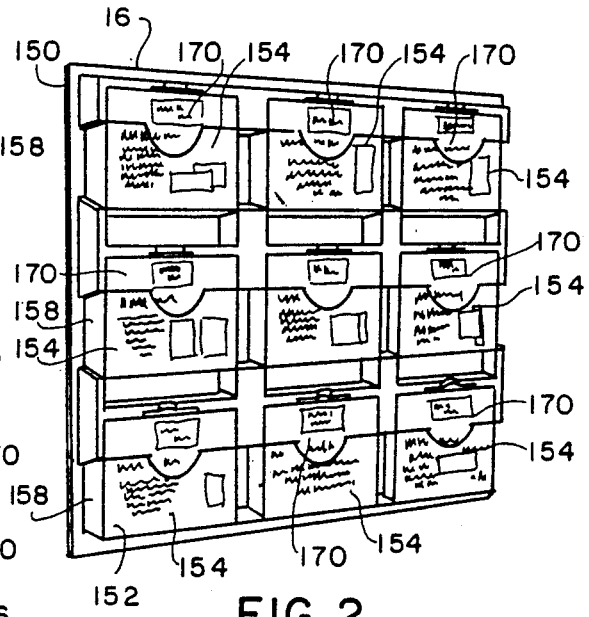
FIG. 2 is an isometric view of a removable modular coupon holder of the coupon display and distribution shown in FIG. 1.
Figure 4:
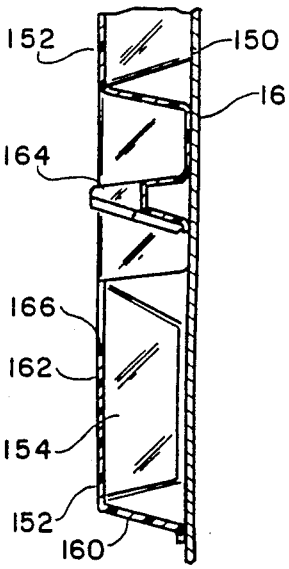
FIG. 4 is an elevational view, having portions broken away, of the removable modular coupon holder without coupons positioned therein shown in FIG. 2.
Figure 3:
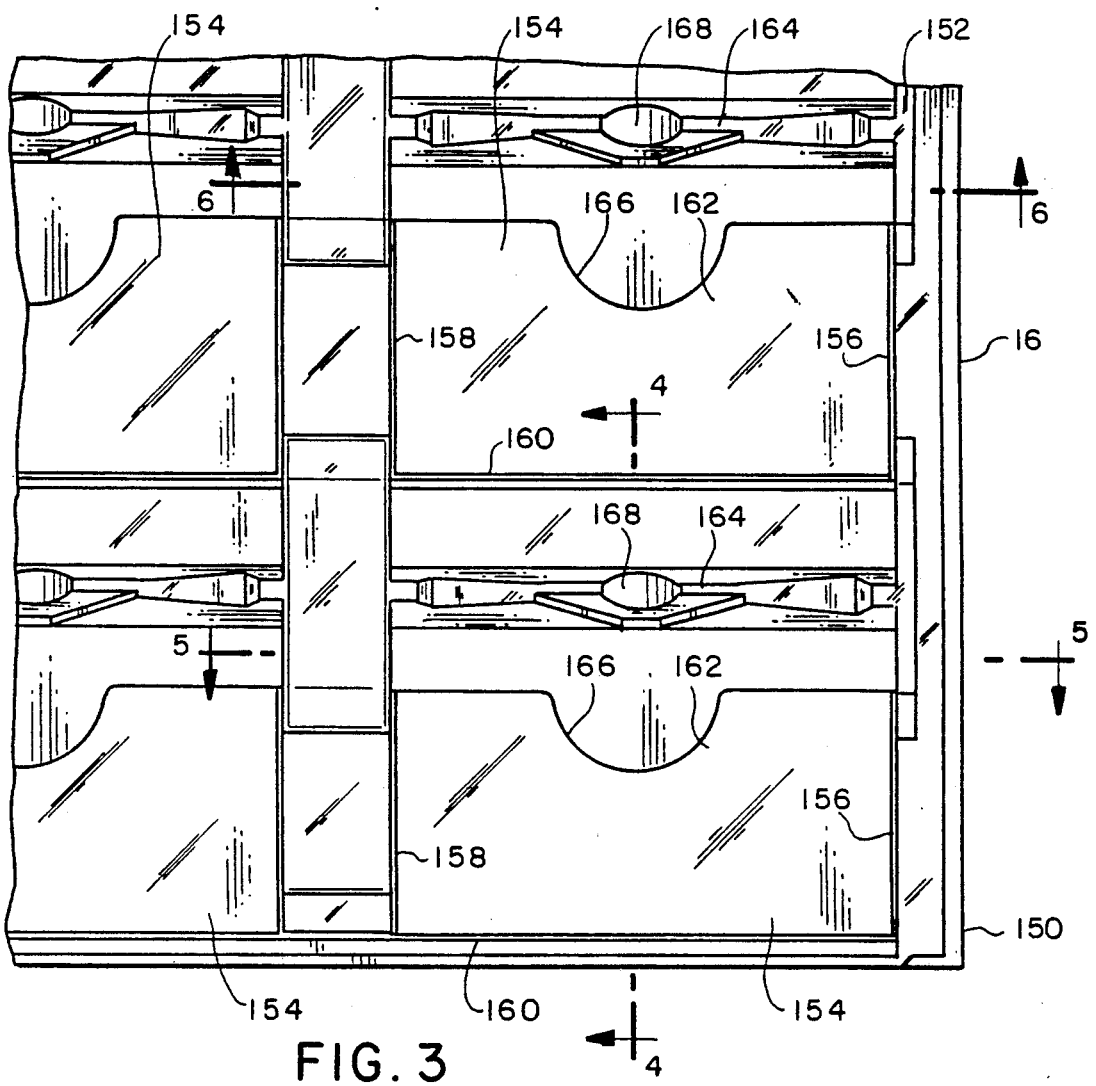
FIG. 3 is a sectional view, having portions broken away, of the removable modular coupon holder, without coupons positioned therein, shown in FIG. 2.
Figure 5:
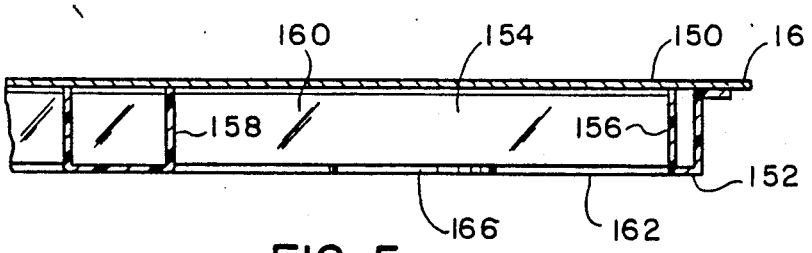
FIG. 5 is a sectional view taken along line 5—5 of FIG. 3 showing details of the removable modular coupon holder.
Figure 6:
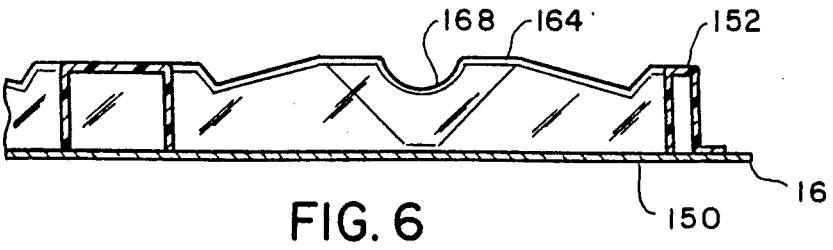
FIG. 6 is a sectional view taken along line 6—6 of FIG. 3 showing details of the removable modular coupon holder.

Referring now to the drawings, and especially to FIG. 1, a free standing coupon display and distribution unit or kiosk embodying the present invention and generally identified by the numeral 10 is shown therein. The coupon display and distribution unit 10 has a base 12 for supporting the coupon display and distribution unit 10 on a horizontal surface such as a floor of a retail store. A plurality of channel or frame members 14, comprising a coupon display and distribution frame 15, is connected to the base 12 and is supported thereby. A plurality of removable modular rectangular coupon holders 16 is slidably supported by the plurality of frame members 14.

The base 12 includes a circular base plate 18 which rests on the floor of the retail store. A triangular cross-section pedestal 20 extends from the base plate 18 to the frame members 14 and the coupon holders 16. The triangular pedestal 20 has three rectangular pedestal panels, 22, 24 and 25. The pedestal panels 22, 24 and 25 are connected to a plurality of pedestal frame members 26 which extend upwardly from the base plate 18. The plurality of pedestal frame members 26 includes a frame member 28 connected to the pedestal panel 22 and to the pedestal panel 24. A frame member 30 is connected to the pedestal panels 22 and 25 and a frame member 32 is connected to the pedestal panels 24 and 25. A pedestal dispensing unit 34 is positioned in the pedestal panel 22. The pedestal dispensing unit 34 is partially defined by the pedestal panel 22 defining an opening 36 therein.

Figure 7:
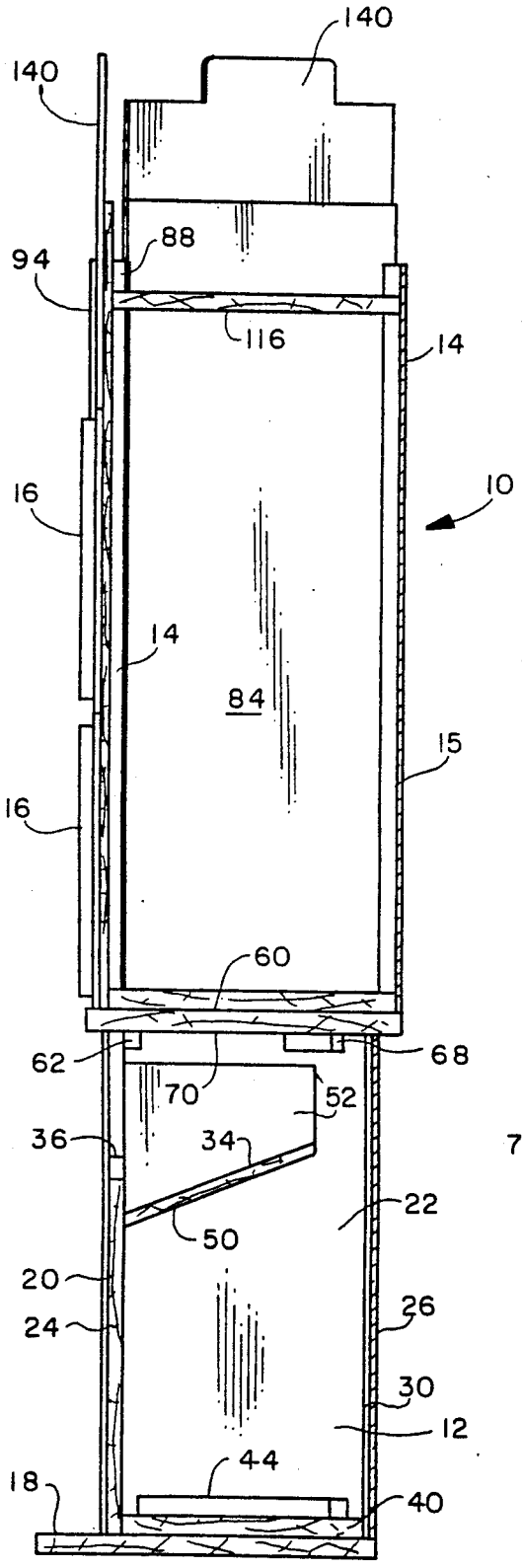
FIG. 7 is a sectional view of the coupon display and distribution unit shown in FIG. 1.
Figure 8:
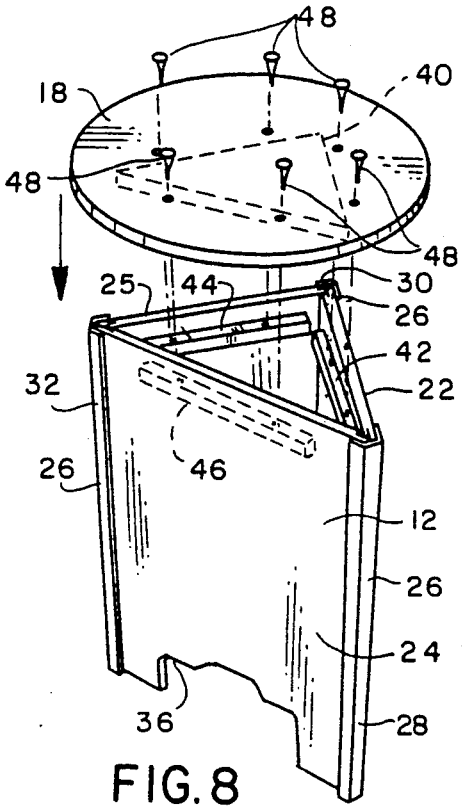
FIG. 8 is an exploded perspective view, oriented upside-down, of the base of the coupon display and distribution unit shown in FIG. 1.
Figure 9:
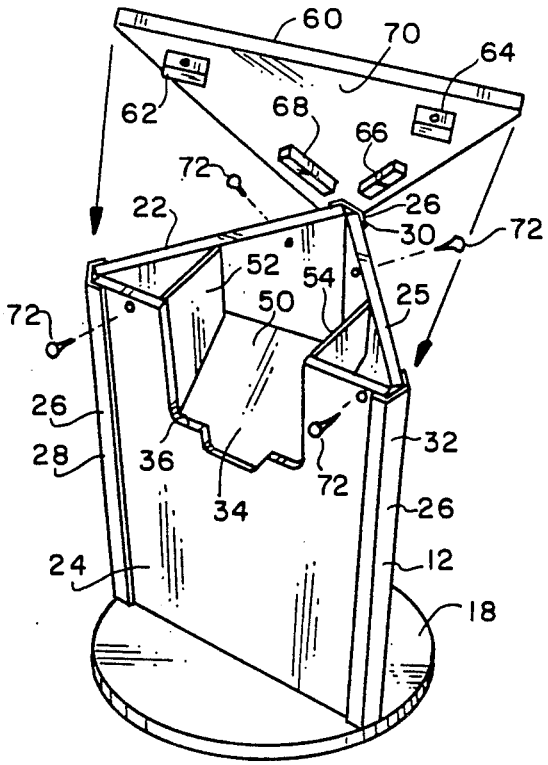
FIG. 9 is an exploded perspective view of the base of the coupon display and distribution unit shown in FIG. 1.

Referring now in particular to FIGS. 7, 8, 9 and 12, the pedestal 20 and the base 18 are shown therein. As may best be seen, the base 18 is a substantially circular disk having a triangular alignment member 40 attached to one side thereof. Each of the panels 22, 24 and 25 has a respective rectangular cleat 42, 44 and 46 connected thereto, to which the base plate 18 is attached by a plurality of wood screws 48. Referring now in particular to FIGS. 7 and 9, the opening 36 formed in the panel 24, has attached to it a portion of the pedestal dispensing unit 34, which is substantially U-shaped having an inclined bottom wall 50, a first side wall 52 and a second sidewall 54. The edges of walls 50, 52 and 54 are attached to the panel 24. A triangular base cover 60 having cleats 62, 64, 66 and 68 attached to an underside 70 thereof is connected to the panels 22, 24 and 25 by a plurality of screws 72, as may best be seen in FIG. 9.

Figure 10:
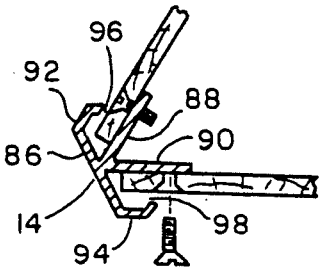
FIG. 10 is a sectional view, having portions broken away, of a connecting bracket of the coupon display and distribution unit shown in FIG. 1 with the removable modular coupon holder removed.
Figure 11:
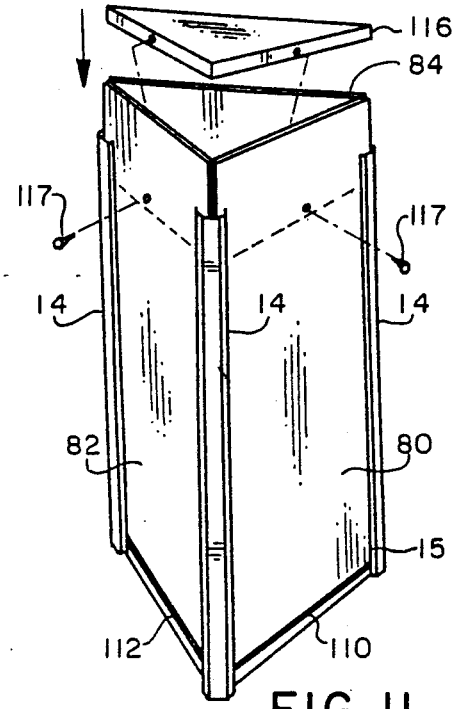
FIG. 11 is an exploded perspective view of the upper portion of the coupon display and distribution unit shown in FIG. 1.
Figure 12:
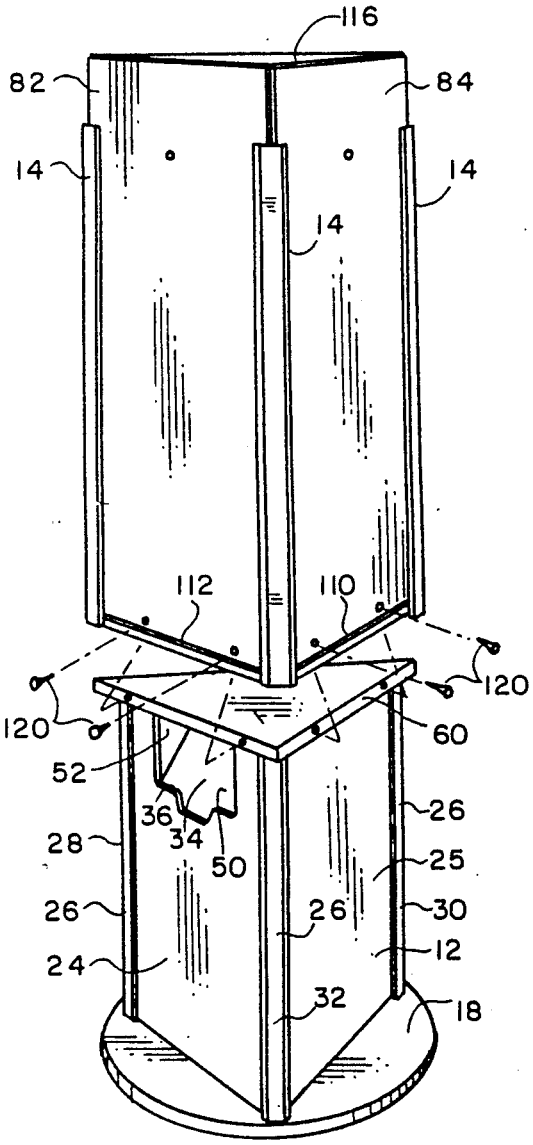
FIG. 12 is a partially exploded of a portion of the coupon display and distribution unit shown in FIG. 1.
Figure 13:
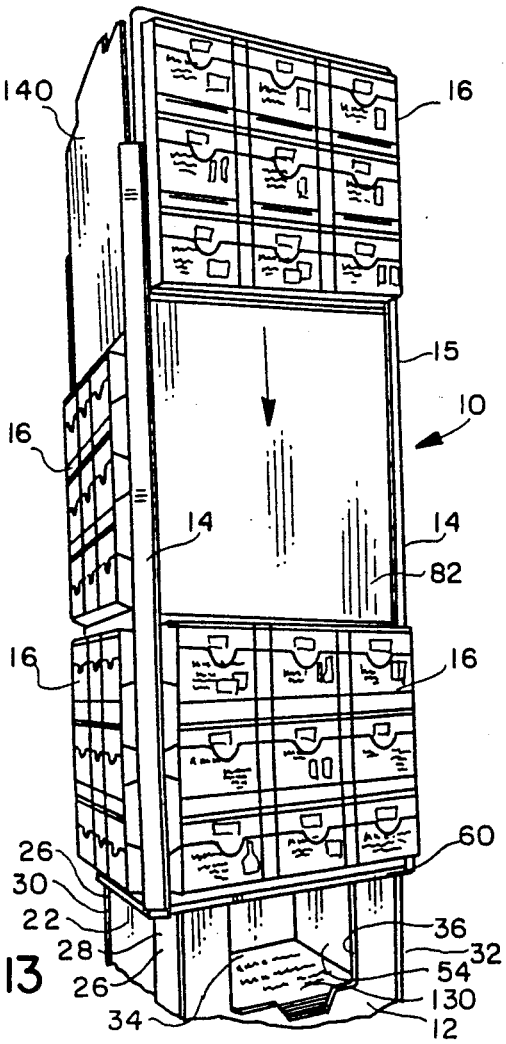
FIG. 13 is an isometric view of the coupon display and distribution unit shown in FIG. 1, having portions broken away, showing the manner in which a removable modular coupon holder is loaded into the connectors of the unit.

The upper portion of the kiosk 10 is assembled, as may best be seen in FIGS. 10, 11 and 12 by nesting a plurality of upper backing panels 80, 82 and 84 in channel members 14. As may best be seen in FIG. 10, a section of the channel member 14 is shown with an outer plate 86 to which is connected a pair of V walls 88 and 90 formed integrally therewith. An outer holder wall 92 is formed integrally with wall 96 as is an outer holder wall 94. Plate 88 and wall 92 define a first channel 96. Plates 90 and 94 define the second channel 98. The frame members 14 are connected together by a cleat 110 bounding the bottom of panel 80, a cleat 112 bounding the bottom of panel 82 and a cleat bounding the bottom of panel 84 which is not shown. A triangular top member 116 is connected by screws 117 to the upper parts of the upper backing panels 80, 82 and 84.

As may best be seen in FIG. 12, the entire upper assembly is then connected to the triangular base cover 60 by a plurality of screws 120. Once assembled in this fashion, the pedestal dispensing unit or pocket 34 may receive promotional material 130 to be dispensed. Likewise, the removable modular rectangular coupon holder 16 may be slid over the structural panels 80, 82 and 84, for instance, in the channel spaces 96 and 98 where they are held. Two of the removable coupon holders 16 each may be stacked one on top of the other. A separate display card 140 may then be placed on the top of each of the coupon holders for display of additional information.

Referring now to FIGS. 1, 2, 3, 4, 5 and 6, the removal modular coupon holder 16 is shown therein. The removal modular coupon holder 16 includes a fiberboard or cardboard backing 150 having a transparent molded styrene wall structure 152 adhesively attached thereto. The molded styrene wall structure 152, together with the backing 150 defines nine rectangular coupon receiving and holding pockets 154, each of the pockets 154 being substantially identical to the other. Each of the pockets 154 has integrally formed a pair of vertical sidewalls 156 and 158, a bottom wall 160, an outer wall 162 and a coupon abutment 164. The outer wall 162 has a scallop or cutout 166 formed therein for ease of access to the coupons. The coupon abutment 164 has a scallop or cutout 168 formed therein, also for easy access to the coupons. A plurality of coupons 170 is positioned within each of the pockets 154.

Each of the removable modular coupon holders 16 is loaded with pluralities of coupons 170 in the pockets 154 and may be shipped to the store where the coupon holders may be slid into the channel members 14 and held against the upper panels 80, 82 and 84, respectively. Each of the upper panels can accommodate two of the coupon holders 16 and the separate indicia card 140 positioned above the coupon holders 16. When the coupons 170 are exhausted, either partially or entirely, the coupon holder 16 may be removed and a fresh coupon holder 16 loaded with new coupons 170 may be substituted within a minute or less, thereby enabling rapid reloading of the coupon display and dispensing unit 10 in the store with minimal disruption to the merchant.

It may be appreciated then that the instant invention is directed to a coupon display and distribution unit or kiosk 10 having removable modular coupon holders 16 with a plurality of rectangular pockets 154 formed therein. The coupon holders 16 may be rapidly exchanged when the coupons 170 are depleted therefrom. The coupon holder pockets 154 have front walls 162 formed of transparent styrene plastic so that the customer may quickly and easily view all of the coupons to determine which he or she may wish to take.

There has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. A coupon display and distribution unit, comprising:

a plurality of channel members having longitudinal slots formed therein; and a removable modular coupon holder slidably received in two of said channel members, said removable modular coupon holder having a plurality of coupon holding pockets formed therein, each of said coupon holding pockets having a transparent front face extending a distance sufficient to cover substantially all of a coupon placed in said coupon holding pocket.

2. A coupon display and distribution unit as defined in claim 1, wherein said coupon holding pockets further comprise plastic coupon holding pockets.

3. A coupon display and distribution unit as defined in claim 1, wherein said plurality of channel members further comprises three channel members.

4. A coupon display and distribution unit as defined in claim 1, wherein said removable modular coupon holder is rectangular.

5. A coupon display and distribution unit as defined in claim 1, further comprising a base supporting the removable modular coupon holder and the channel members, said base having a base dispensing pocket formed therein for holding promotional materials to be dispensed.

6. A method of displaying and dispensing coupons, comprising:

loading with coupons to be displayed and distributed a multiple pocket coupon holder having a plurality of coupon holding pockets, each of said coupon holding pockets having a transparent front face extending a distance sufficient to cover substantially all of a coupon placed in said coupon holding pocket;

transporting the loaded multiple pocket coupon holder to a business having a coupon display and distribution frame;

loading the multiple pocket coupon holder into the coupon display and distribution frame; and removing the multiple pocket coupon holder from the coupon display and distribution frame when it is desired to display other coupons.

* * * * *

UNITED STATES PATENT AND TRADEMARK OFFICE

CERTIFICATE OF CORRECTION

PATENT NO. : 5,050,747

DATED : September 24, 1991

INVENTOR(S) : Krautsack, Richard G.

It is certified that error appears in the above-identified patent and that said Letters Patent is hereby corrected as shown below:

In column 1, line 22, delete "in".

In column 2, line 57, change "an isometric" to --a perspective--.

In column 2, line 61, insert --unit-- after "distribution".

In column 2, line 63, change "a sectional" to --an elevational--.

In column 2, line 66, change "an elevational" to --a sectional--.

In column 3, line 22, insert --view-- after "exploded".

In column 4, lines 40-41, change "removal" to --removable--.

UNITED STATES PATENT AND TRADEMARK OFFICE

CERTIFICATE OF CORRECTION

PATENT NO. : 5,050,747

DATED : September 24, 1991

INVENTOR(S) : Krautsack, Richard G.

It is certified that error appears in the above-identified patent and that said Letters Patent is hereby corrected as shown below:

In column 4, line 42, change "removal" to --removable--.

Signed and Sealed this

Ninth Day of March, 1993

*Attest:*

STEPHEN G. KUNIN

*Attesting Officer*

*Acting Commissioner of Patents and Trademarks*